United States Patent [19]

Judson

[11] 4,285,375

[45] Aug. 25, 1981

[54] T-BAR RATCHETING SCREWDRIVER

[76] Inventor: J. Bruce Judson, 1711 Kenora Dr., Escondido, Calif. 92027

[21] Appl. No.: 161,587

[22] Filed: Jun. 20, 1980

[51] Int. Cl.[3] ..... B25G 1/08

[52] U.S. Cl. ..... 145/77; 145/75

[58] Field of Search ..... 145/77, 65, 75

[56] References Cited

U.S. PATENT DOCUMENTS

| | | | |
|---|---|---|---|
| D. 159,482 | 8/1950 | Garbs | 145/65 |
| 304,102 | 8/1884 | Hermann | 145/77 |
| 323,145 | 7/1885 | Hermann | 145/77 |
| 366,439 | 7/1887 | Troy | 145/75 |
| 388,637 | 8/1888 | Cross | 145/77 |
| 1,897,854 | 2/1933 | Myers et al. | 145/77 |
| 2,271,887 | 2/1942 | Kalbeck | 145/75 |

FOREIGN PATENT DOCUMENTS

| | | | |
|---|---|---|---|
| 54448 | 4/1919 | Sweden | 145/77 |
| 894363 | 4/1962 | United Kingdom | 145/75 |

*Primary Examiner*—Stephen G. Kunin
*Assistant Examiner*—J. T. Zatarga
*Attorney, Agent, or Firm*—Brown & Martin

[57] ABSTRACT

A screwdriver assembly includes a detachable handle, a fixed non-rotatable socket and a dual ratcheting socket extending transverse to the axis of the handle to the screwdriver with the dual sockets to obtain reversal of the screwdriver rotation.

2 Claims, 4 Drawing Figures

T-BAR RATCHETING SCREWDRIVER

BACKGROUND OF THE INVENTION

The present invention relates to tools and pertains to particularly to a ratcheting T-Bar handle screwdriver.

Screwdrivers having a multiple detachable shank are very useful and are generally known. Screwdrivers having a ratcheting handle in the form of a large spherical ball are also known. These, however, have some drawbacks which the present invention is designed to overcome. The problem of most detachable shank screwdrivers is that they are not ratcheting. The ratcheting handle is very helpful in close work, that is, where room to manipulate the screwdriver and or other tools is lacking. For this reason the ratcheting type handle is very useful.

The ball type handle screwdrivers however, have a major drawback in that they are large and take up a considerable amount of room and do not provide for maximum torque for a given size.

It is therefore desirable that an improved ratcheting screwdriver be available that is effective to provide high torque to the screwdriver shank.

SUMMARY OBJECTS OF THE INVENTION

It is the primary object of the present invention to overcome the above problems of the prior art.

Another object of the present invention is to provide an improved ratcheting screwdriver that is simple and inexpensive to manufacture.

A further object of the present invention is to provide an improved ratcheting screwdriver that provides means for applying maximum torque to a screw.

In accordance with a primary aspect of the present invention, a screwdriver assembly includes a generally cylindrical handle having a ratcheting socket intermediate the ends thereof and transverse to the axis thereof for receiving the shank of a screwdriver for applying to the screwdriver shank a maximum torque.

BRIEF DESCRIPTION OF THE DRAWINGS

The above and other objects and advantages of the present invention will become apparent from the following description when read in conjunction with the drawings wherein.

DETAILED DESCRIPTION OF THE PREFERRED EMBODIMENT

Figure 1:
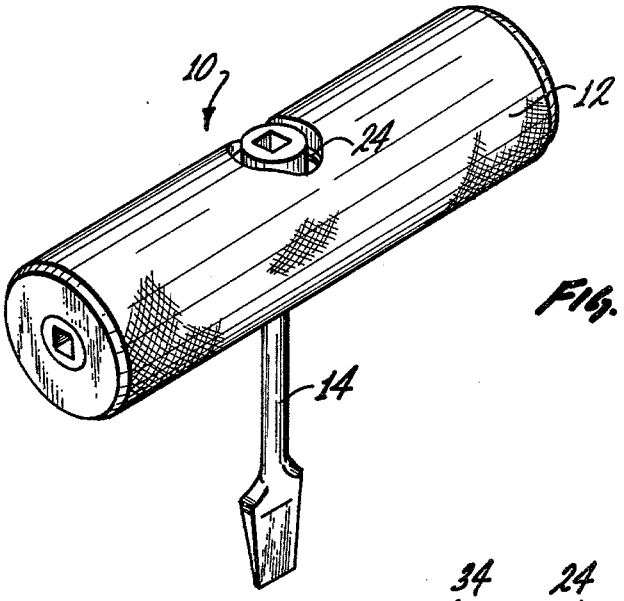
FIG. 1 is a perspective view of a screwdriver assembly in accordance with the invention.

Turning to the drawings, there is shown in FIG. 1 a screwdriver assembly designated generally by the numeral 10 in accordance with the present invention and having a generally cylindrical handle 12 having a screwdriver shank 14 shown detachably mounted in a ratcheting socket assembly to be described.

Figure 2:
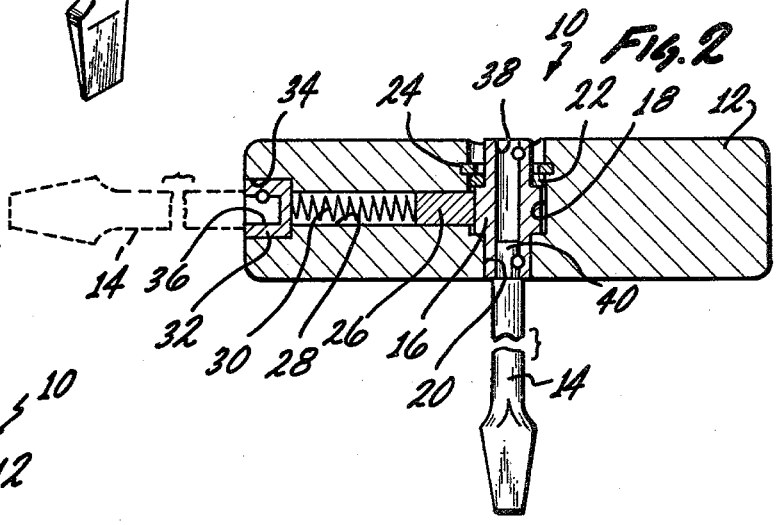
FIG. 2 is a side elevational view of the screwdriver with portions broken away in section to show detail.
Figure 4:
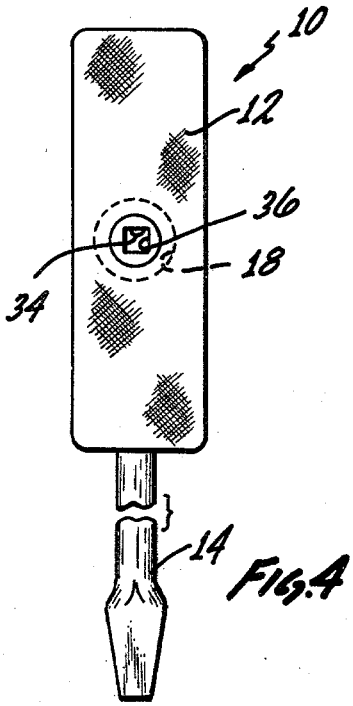
FIG. 4 is an elevational view of a screwdriver with the handle and shank in a different orientation.

Turning to FIG. 2, the assembly is shown in section, illustrating a ratchet wheel or rotor 16 rotatably mounted within a generally cylindrical bore 18 extending transverse through the axis of the generally cylindrical handle 12. The ratchet wheel 16 includes a hub extending axially to both sides of the central wheel portion and one of the hubs extending into a reduced stepped portion of the bore 18. The ratcheting wheel 16 abrupts against a shoulder formed by the wall between the stepped bore 18, 20. A retaining ring or washer 22, and a retaining ring or the like 24 retains the rotor or ratchet wheel 16 within the bore.

The ratchet wheel 16 includes serrations or teeth on the outer surface or diameter thereof, which teeth are engaged by a pawl member 26. The pawl member 26 is mounted within a generally square or rectangular channel or bore 28 extending generally parallel to the axis of the handle 12. A spring 30 is mounted in bore 28 and the pawl 26 into engagement with the ratchet wheel 16. The spring and ratchet pawl member are retained in position by means of a socket plug or member 32 which is preferably pressed fitted within a bore or the like 34 formed in the end of the handle 12. The socket is preferably non-rotatably mounted and fixed within the end of the handle and includes a shank receiving socket 36 for receiving the shank end of a screwdriver member 14.

The ratchet wheel 16 includes a through bore or the like forming a socket 38 opening on opposite sides of the handle 12 for receiving the shank end 40 of the tool or screwdriver 14.

Figure 3:
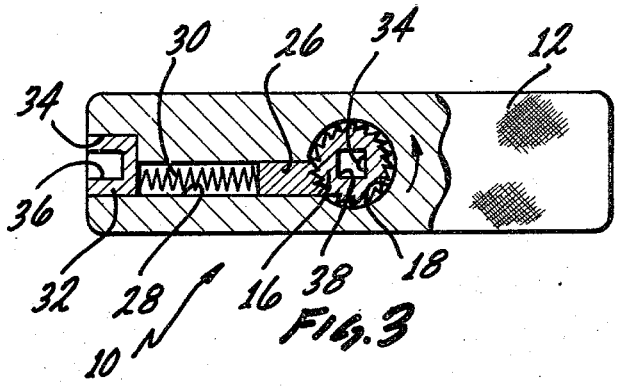
FIG. 3 is a top view of the screwdriver of FIG. 1 with portions and sections to details.

Turning to FIG. 3 of the drawing, the pawl member 26 is shown offset to one side of the axis of the ratchet wheel 16 and the axis of the handle 12. This places the pawl to one side to prevent rotation of the ratchet of the ratchet wheel 16 as shown in FIG. 3 in the clockwise direction but permits rotation in the counterclockwise direction. This permits the handle to be ratcheted in the clockwise direction with torque applied to a screwdriver shank mounted in the socket and extending away from the observer. Likewise, movement of the handle in the counterclockwise direction will rotate the ratchet wheel and shank with the handle.

The pawl member 26 and spring 30 are retained in the channel 28 in which they are mounted by means of the socket member 32. This above-described construction provides a simple inexpensive ratcheting mechanism which can be reversed simply by pulling the handle 12 off the end of the screwdriver shank and rotating it a 180° about its axis and placing it back on the end of the shank. A complex reversing mechanism is therefore not required. Preferably, the bore 28 within the ratchet wheel or rotor 16 is either square or hexagonal in configuration or some similar cross-sectional configuration to permit the application of rotary torque to the screwdriver. The T-handle construction as shown herein permits a large amount of torque to be applied to the shank of the screwdriver. The lever arm provided by the handle 12 provides an extensive torque applying mechanism. This handle also provides a large area for applying force along the screwdriver shank such as by the palm or heel of the hand. The handle 12 is preferably knurled or roughened to provide for a good nonslip grip by the hand.

The T-Bar construction also provides a handle which is preferably of a comfortable diameter and of a length to extend substantially across the palm of an operator's hand such that the hand palm or heel of the hand can be used to apply a force on the handle forcing the screwdriver into tight engagement with the screw at the same time that torque is being applied thereto.

In addition to these advantages, the fixed socket 32 in the end of the handle permits the screwdriver shank to be inserted in that socket for use in a conventional manner. Any number of different size and type screwdriver shanks and or wrench assemblies can be utilized in conjunction with the handle. Preferably, detent retainers are utilized to retain the shanks in the position in the socket. Position type ball detents 34 are illustrated as an example. With this arrangement, the handle and a considerable number of screwdriver tips or other tool shanks can be bundled together in a compact bundle and be placed in a tool chest and be available when needed. This eliminates the extensive space requirement of multiple screwdrivers as well as the conventional popular ball handle type screwdriver.

In addition, the above-described construction is simple and inexpensive and eliminates complex reversing mechanism.

While I have illustrated and described my invention by means of specific embodiments it is to be understood that numerous changes and modifications may be made therein without departing from the spirit and scope of the invention as defined in the appended claims.

I claim:

1. A T-bar ratcheting screwdriver assembly comprising in combination:

an elongated generally cylindrical handle for grasping in the hand including a socket fixed co-axially thereof for detachably receiving a screwdriver shank for rotation therewith, ratchet rotor means having teeth formed on the outer diameter thereof, and mounted in a transverse bore substantially midway between the ends of said handle and having a rotary axis transverse to the axis of said handle and a shank receiving socket in each end thereof extending to and accessible to opposite sides of said handle for alternately detachably receiving a screwdriver shank for reversible rotation thereof by said handle, and a pawl member slideably mounted in a channel extending along the axis of said handle and biased into engagement with said teeth, a screwdriver stem having a shank portion for removably mounting in said socket for rotation therewith said handle includes a bore coaxially in one end thereof communicating with said channel, and a plug member having said socket therein press fitted into said bore.

2. The screwdriver of claim 1 including a spring mounted in said channel between said plug member and said pawl member for biasing said pawl member into engagement with said ratchet rotor.

* * * * *